US007282678B2

(12) United States Patent
Tung et al.

(10) Patent No.: US 7,282,678 B2
(45) Date of Patent: Oct. 16, 2007

(54) ELECTRIC HEATING MODULE

(75) Inventors: Chao-Nien Tung, Guangdong (CN); Chuen-Shu Hou, Guangdong (CN); Chih-Hao Yang, Guangdong (CN)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/308,698

(22) Filed: Apr. 24, 2006

(65) Prior Publication Data

US 2007/0000898 A1 Jan. 4, 2007

(30) Foreign Application Priority Data

Jul. 2, 2005 (CN) ..... 2005 1 0035779

(51) Int. Cl.
*H05B 3/06* (2006.01)
*H01C 7/10* (2006.01)

(52) U.S. Cl. ..... 219/520; 219/540; 219/541; 219/542; 219/544; 219/530; 219/504; 219/505; 219/553; 338/22; 338/23

(58) Field of Classification Search ..... 219/540–542, 219/520, 544, 530, 504–505, 553; 338/22 R, 338/23, 22

See application file for complete search history.

(56) References Cited

U.S. PATENT DOCUMENTS 5,995,711 A * 11/1999 Fukuoka et al. ..... 392/347
6,720,536 B2 4/2004 Bohlender

* cited by examiner

*Primary Examiner*—Shawntina Fuqua
(74) *Attorney, Agent, or Firm*—Winston Hsu

(57) ABSTRACT

An electric heating module includes an electric heater (10), a heat pipe (20) having an evaporating section (22) thermally attached to the electric heater and a condensing section (24), and at least one heat radiator (30, 40) thermally attached to the condensing section. The electric heater includes a pair of electrode plates (12, 14) and a heating element (16) sandwiched between and electrically connecting the electrode plates. An insulation frame (19) encloses the electrode plates therein for electrically insulating the electric heater from the heat radiator. For the non-linear PTC heating element, the electric heater can rapidly heat up to and stay at a desired stable temperature. The heat pipe can transfer heat from the electric heater to the heat radiator rapidly and timely by phase change.

20 Claims, 6 Drawing Sheets

ELECTRIC HEATING MODULE

FIELD OF THE INVENTION

The present invention relates generally to electric heating modules, and more particularly to an electric heating module having a PTC (Positive Temperature Coefficient) heating element.

DESCRIPTION OF RELATED ART

Electric heating devices are commonly used to warm body parts, in air conditioning, in motor vehicles, in industrial plants and the like. A conventional electric heating device comprises a base having at least one electric heating element supported on or adjacent thereto. The heating elements are generally of coiled wire or ribbon form, having electrical terminals at opposite ends thereof for connection to a power supply. A rod-like heat sensor is generally provided extending at least partly across the heating device and overlying the heating elements to sense the temperature of the electric heating device.

The electric heating elements are generally made of a metal which can endure high temperatures, such as nickel, chromium or the like. The electrical resistance of the heating elements is thus kept constant with varying temperature. During operation of the heating device, an electrical current flows through the heating elements, whereby the heating elements generate heat. Due to the constant electrical resistance of the heating elements, initially the heating elements need a relatively longer time to warm up to a predetermined temperature. However, after reaching the predetermined temperature the current continues to supply to the heating elements, whereby the heating device may be overheated. Thus such a heating device is both unsafe and has a low energy conversion efficiency.

Therefore, there is a need for an electric heating module which has a better energy conversion efficiency and for which there is not a danger of overheating.

SUMMARY OF INVENTION

According to a preferred embodiment of the present invention, an electric heating module comprises an electric heater, a heat pipe having an evaporating section thermally attached to the electric heater and a condensing section, and at least one heat radiator thermally attached to the condensing section of the heat pipe. The electric heater comprises a pair of electrode plates parallel to each other and a heating element sandwiched between and electrically connecting the electrode plates. An electrically insulating and thermal conductive insulation frame encloses the electrode plates therein so as to electrically insulate the electric heater from the heat radiator. Due to the non-linear PTC heating element of the heating device, the electric heater can rapidly heat to and stay at a desired stable temperature. The heat transfer efficiency by phase change of working fluid of the heat pipe is hundred times more than that of other mechanisms, such as heat conduction or heat convection without phase change. Therefore the heat pipe can transfer heat from the electric heater to the heat radiator rapidly. Thus this electric heating module enhances the energy conversion efficiency, and improves the security and working life of the heating device.

Other advantages and novel features of the present invention can be drawn from the following detailed description of a preferred embodiment of the present invention with attached drawings, in which:

DETAILED DESCRIPTION

Figure 1:
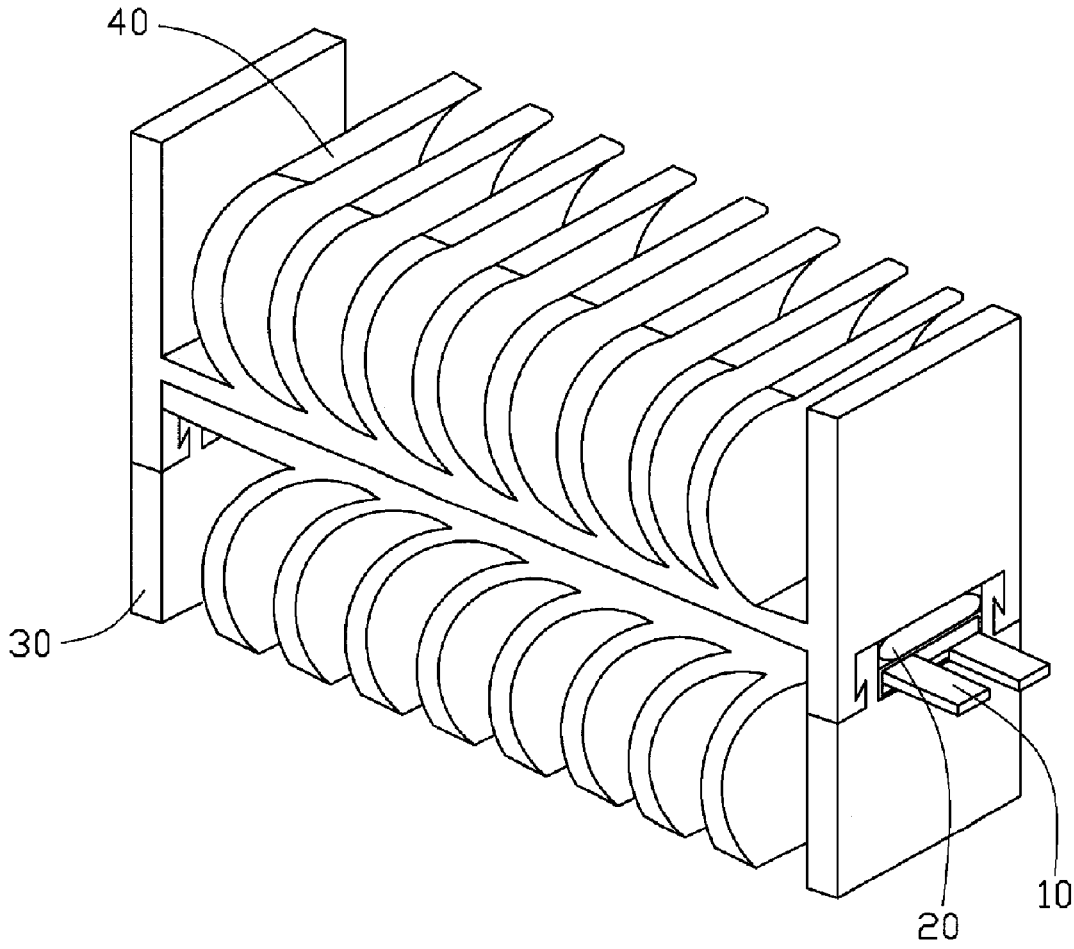
FIG. 1 is an isometric, assembled view of an electric heating module in accordance with a preferred embodiment of the present invention.

Referring to FIG. 1, an electric heating module according to a preferred embodiment of the present invention includes an electric heater 10, a heat pipe 20 thermally attached to the electric heater 10, and first and second heat radiators 30, 40 thermally attached to the heat pipe 20.

Figure 2:
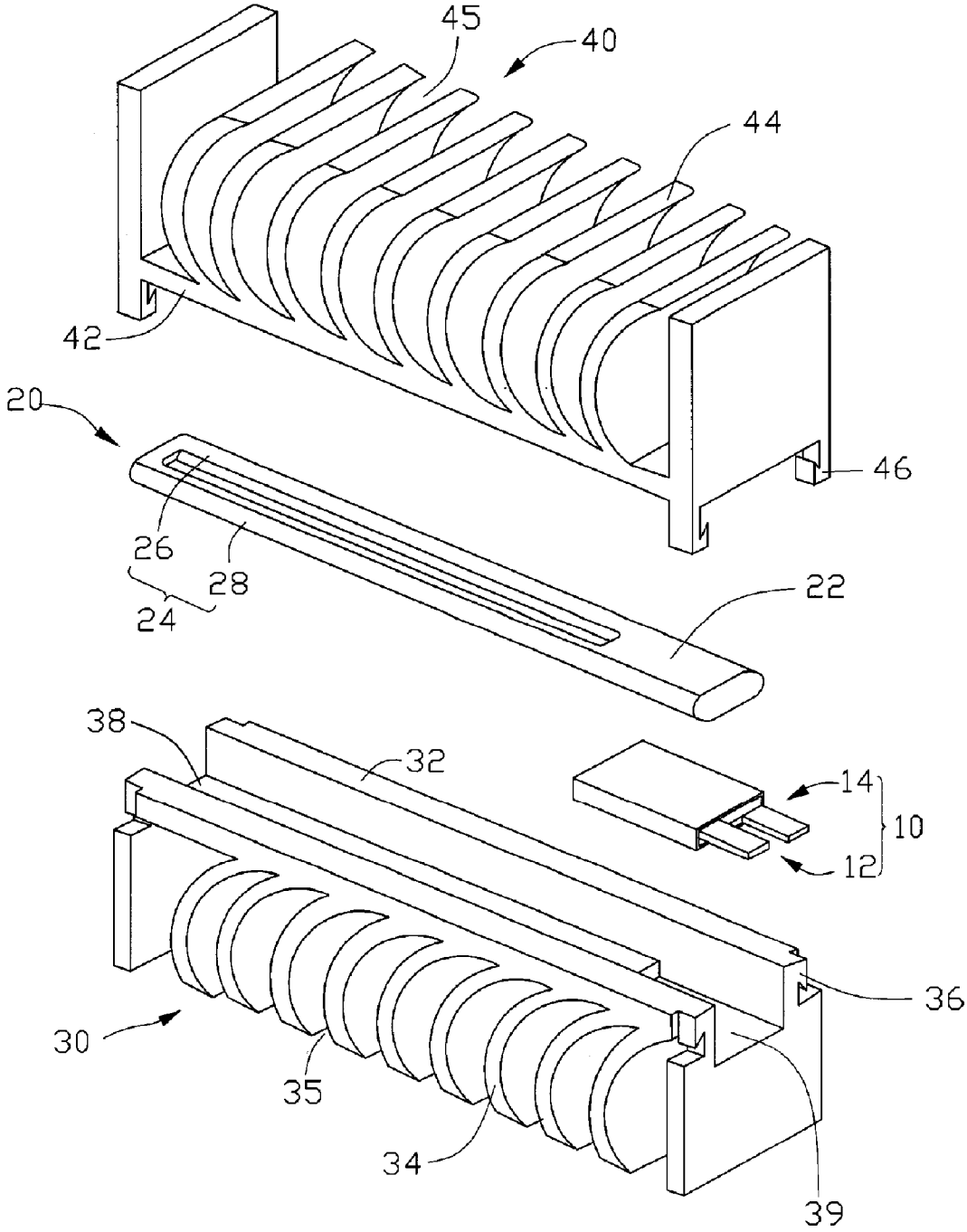
FIG. 2 is an isometric, exploded view of the electric heating module of FIG. 1.
Figure 3:
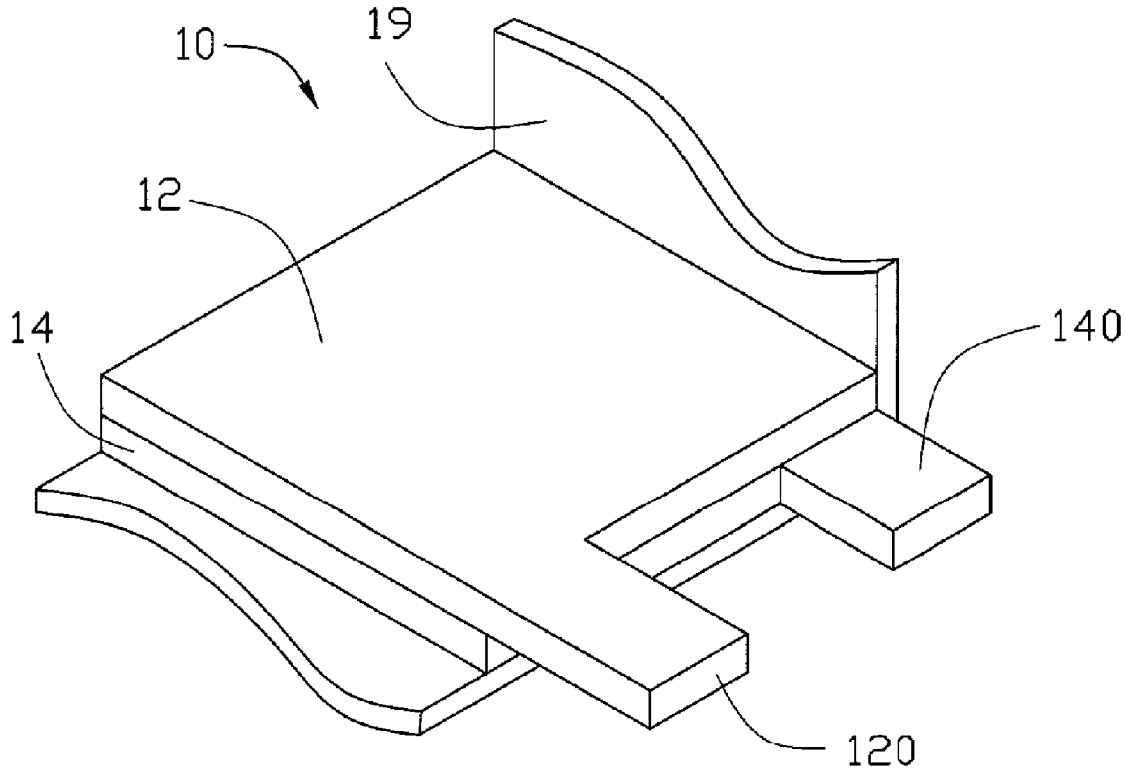
FIG. 3 is an isometric view of an electric heater with an unfurled insulation frame of the electric heating module.
Figure 4:
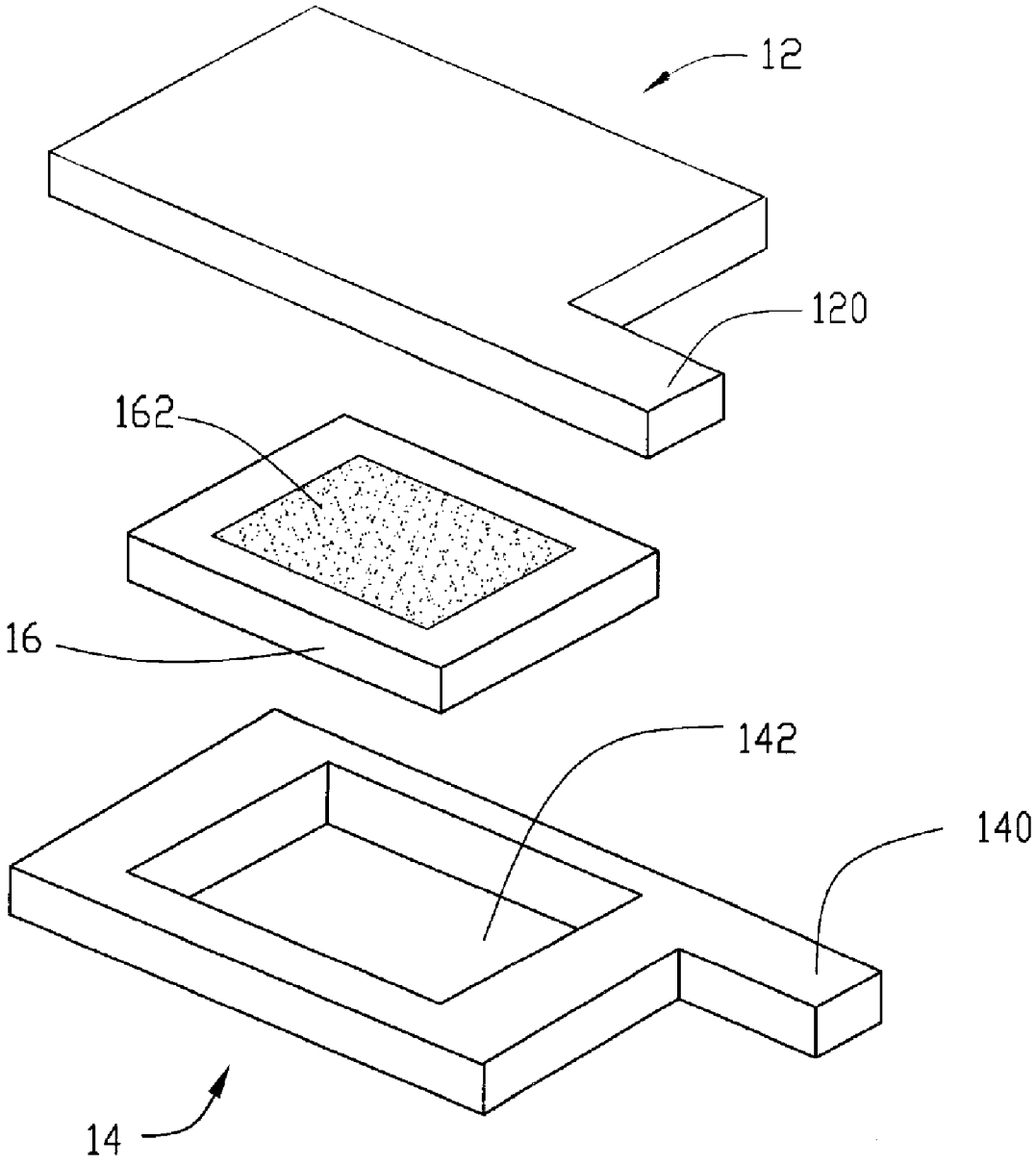
FIG. 4 an isometric, exploded view of the electric heater.

Referring to FIGS. 2-4, the electric heater 10 includes upper and lower electrode plates 12, 14 arranged parallel to each other, and a PTC (Positive Temperature Coefficient) heating element 16 sandwiched therebetween. Each of the electrode plates 12, 14 is rectangular shaped and thin, and includes an inner surface electrically contacting the heating element 16 and an outer surface opposite to a corresponding inner surface. A slot 142 is defined in the inner surface of the lower electrode plate 14 for receiving the heating element 16 therein. The slot 142 has a depth approximately equal to or less than the height of the heating element 16. Electric terminals 120, 140 are formed on ends of the electrode plates 12, 14, respectively, to electrically connect them to a power source (not shown).

The PTC heating element 16 is made of semi-conductive ceramic based on $BaTiO_3$ (where Ba is barium, Ti is titanium and O is oxygen) composition and has an electric layer 162 coated on two opposite sides thereof for electrically contacting with the electrode plates 12, 14. The electric layers 162 are made of a material having an excellent electrical conductivity, such as metal, metal oxide, superconducting materials, etc. The metal oxide can be selected from one of ITO-based (where I is indium, and T is tin) materials or IZO-based (where I is indium, and Z is zinc) materials. The superconducting materials can be selected from one of the following materials: $YBa_2Cu_3O_7$ (where Y is yttrium, and Cu is copper), $LaSr_2Cu_3O_7$ (where La is lanthanum, and Sr is strontium) and their composites. The heating element 16 is formed in a flat rectangular shape. Alternatively, the heating element 16 can be manufactured in other forms, such as circular or donut-shaped. Because of the non-linear positive temperature coefficient of the heating element 16, electrical resistance of the PTC heating element 16 varies with its temperature. When the temperature of the heating element 16 is below the Curie point, the electrical resistance value slightly decreases as temperature rises. But when the temperature exceeds the Curie point, the resistance increases abruptly. The Curie point is the temperature at which the resistance of the heating element 16 begins to rise sharply and the resistance value is approximately twice the minimum resistance. The Curie point can be adjusted as required by changing the composition of the heating element 16.

An insulation frame 19 covers the electrode plates 12, 14 so as to insulate the electric heater 10 from the heat radiators 30, 40. The insulation frame 19 is made of electrical insulation material with excellent thermal conductivity, such as a ceramic substrate or polymer material. Thus the heat generated by the electric heater 10 can be conducted to the heat radiators 30, 40 quickly and reliably.

The heat pipe 20 is planar shaped and has planar shaped bottom and top outer surfaces which respectively thermally contact the first and second heat radiators 30, 40. The heat pipe 20 is a loop heat pipe and includes an evaporating section 22 and a condensing section 24. Usually a wick structure (not shown) is disposed on an inner wall of the heat pipe 20. The condensing section 24 includes a forwarding portion 26 and a returning portion 28. Together the evaporating section 22, forwarding portion 26 and returning portion 28 define a loop for circulating the working fluid of the heat pipe 20. It is well known that the heat transfer efficiency by phase change of liquid (i.e. from liquid to vapor) is better than other mechanisms, such as heat conduction or heat convection without phase change. It is also well known that heat absorbed by liquid having a phase change is hundred times more than that of the liquid without phase change. Therefore the heat pipe 20 is capable of transferring heat from the electric heater 10 to the heat radiators 30, 40 rapidly, thereby improving energy conversion efficiency of the electric heating module. The heat pipe 20 is a hermetically vacuum container, with the working fluid received therein. The working fluid in the evaporating section 22 absorbs heat from the electric heater 10 and becomes vapor. The vapor flows through the forwarding portion 26 and then the returning portion 28 of the condensing section 24, whereby the heat carried by the vapor is transmitted to the heat radiators 30, 40, and the vapor is condensed into liquid. The liquid is drawn back to the evaporating section 22 via the wick structure for a next thermal circulation.

Figure 5:
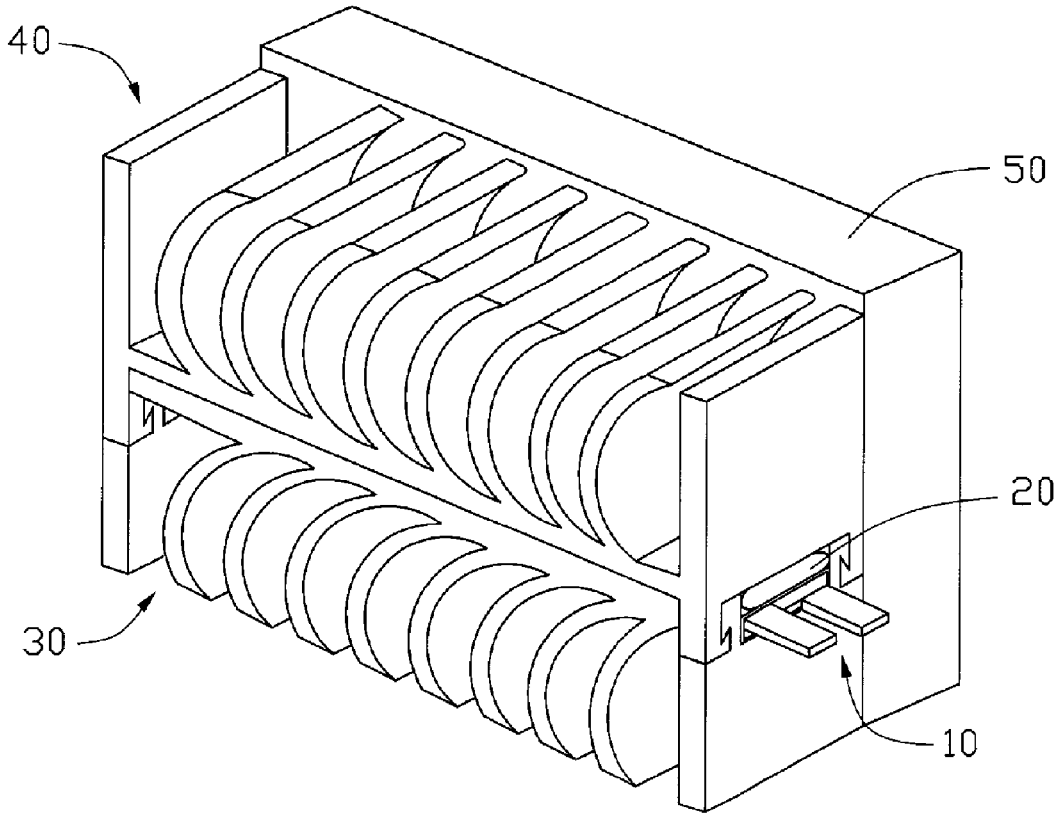
FIG. 5 shows an isometric of the electric heating module with a fan arranged at a side thereof.

Each of the first and second heat radiators 30, 40 includes a base 32, 42 and a plurality of fins 34, 44 respectively extending therefrom. The fins 34, 44 are parallel to each other and each of the fins 34, 44 is arc shaped. An arc shaped flow channel 35, 45 is formed between each pair of neighboring fins 34, 44 for channeling the airflow generated by a fan 50 (FIG. 5). In this embodiment the fins 34, 44 are integrally formed with the base 32, 42. Alternatively, the fins 34, 44 and the base 32, 42 can be formed separately and then joined together by soldering. A notch 39 is defined in an end of the base 32 of the first heat radiator 30 for receiving the electric heater 10 therein. The notch 39 has a depth approximately the same as the height of the electric heater 10. A groove 38 is defined in the base 32 of the first heat radiator 30 above the notch 39 for receiving the heat pipe 20 therein. The groove 38 communicates with the notch 39. A hook extends from each of four corners of each of the first and second heat radiators 30, 40 to the other one of the first and second heat radiators 30, 40. Therefore the first and second heat radiators 30, 40 can engage with each other by each of the hooks 36, 46 locking with a corresponding hook 46, 36 of the other heat radiators 40, 30.

In assembly, the heating element 16 is received in the slot 142 of the lower electrode plate 14. The inner surface of the lower electrode plate 14 electrically contacts the heating element 16. The upper electrode plate 12 covers the lower electrode plate 14 with an inner surface electrically contacting the heating element 16. The insulation frame 19 covers the electrode plate 12, 14 and encloses the PTC heating element 16 therein. Then the notch 39 of the first heat radiator 30 receives the electric heater 10 with the insulation frame 19 wrapped thereon. A bottom wall of the insulation frame 19 thermally attaches to the base 32 of the first heat radiator 30. The heat pipe 20 is received in the groove 38 of the base 32 of the first heat radiator 30. The evaporating section 22 of the heat pipe 20 thermally attaches to a top wall of the insulation frame 19. The bottom outer surface of the condensing section 24 of the heat pipe 20 thermally attaches to the base 32 of the first heat radiator 30. The second heat radiator 40 abuts the top outer surface of the heat pipe 20. Each hook 36, 46 of the first and second heat radiators 30, 40 engages with a corresponding hook 46, 36 of the other heat radiators 40, 30. Therefore the heat radiators 30, 40 lock with each other and sandwich the electric heater 10 therebetween. The bases 32, 42 of the first and second heat radiators 30, 40 thermally attach to the bottom and top outer surfaces of the heat pipe 20, respectively.

As shown in FIG. 5, during operation, the fan 50 is commonly used in combination with the electric heating module to dissipate the heat generated by the electric heating module. The fan 50 is arranged on a side of the electric heater 10 communicating with the flow channels 35, 45 of the first and second heat radiators 30, 40. The electric terminals 120, 140 of the electrode plates 12, 14 connect to the power source through wires (not shown). As voltage is applied to the heating element 16 through the electrical terminals 120, 140 of the electrode plates 12, 14, the current heats the heating element 16. Initially the current increases rapidly and quickly heats the heating element 16 to reach a predetermined temperature. The heat generated by the heating element 16 is conducted to the heat pipe 20 initially. The working fluid saturated in the wick structure of the evaporating section 22 evaporates to vapor due to heat absorbed from the heating element 16. The vapor moves toward the forwarding portion 26 of the condensing section 24 due to the difference of vapor pressure, thus performing heat transport. Then the vapor cools and condenses at the forwarding and returning portions 26, 28 and returns to the evaporating section 22. From the evaporating section 22, the fluid evaporates again to thereby repeat the heat transfer from the evaporating section 22 to the condensing section 24. The heat dissipated from the condensing section 24 of the heat pipe 20 is then conducted to the fins 34, 44 of the heat radiators 30, 40 attached thereon. Thus the heat pipe 20 can transfer heat from the electric heater 10 to the heat radiators 30, 40 rapidly. The airflow generated by the fan 50 flows into the flow channels 35, 45 to exchange heat with the fins 34, 44. Therefore the heat generated by the heating element 16 is dissipated to ambient air rapidly thereby warming the ambient air. When the heating element 16 reaches the Curie point where the heat generated is the same as the heat dissipated, the electrical resistance of the heating element 16 increases sharply, whilst the current supplied to the heating element 16 decreases dramatically. This increase in resistance is sufficient to substantially compensate the reduction of the current supplied to the heating element 16. Thus, a small amount of current flowing through the heating element 16 is sufficient to maintain the temperature of the electric heating module at the required level since the resistance of the heating element 16 is increased. With the non-linear PTC heating element 16, the electric heating module can rapidly heat to and remain at a stable temperature, thereby enhancing the energy conversion efficiency, and improving the reliability and useful life of the heating device.

Figure 6:
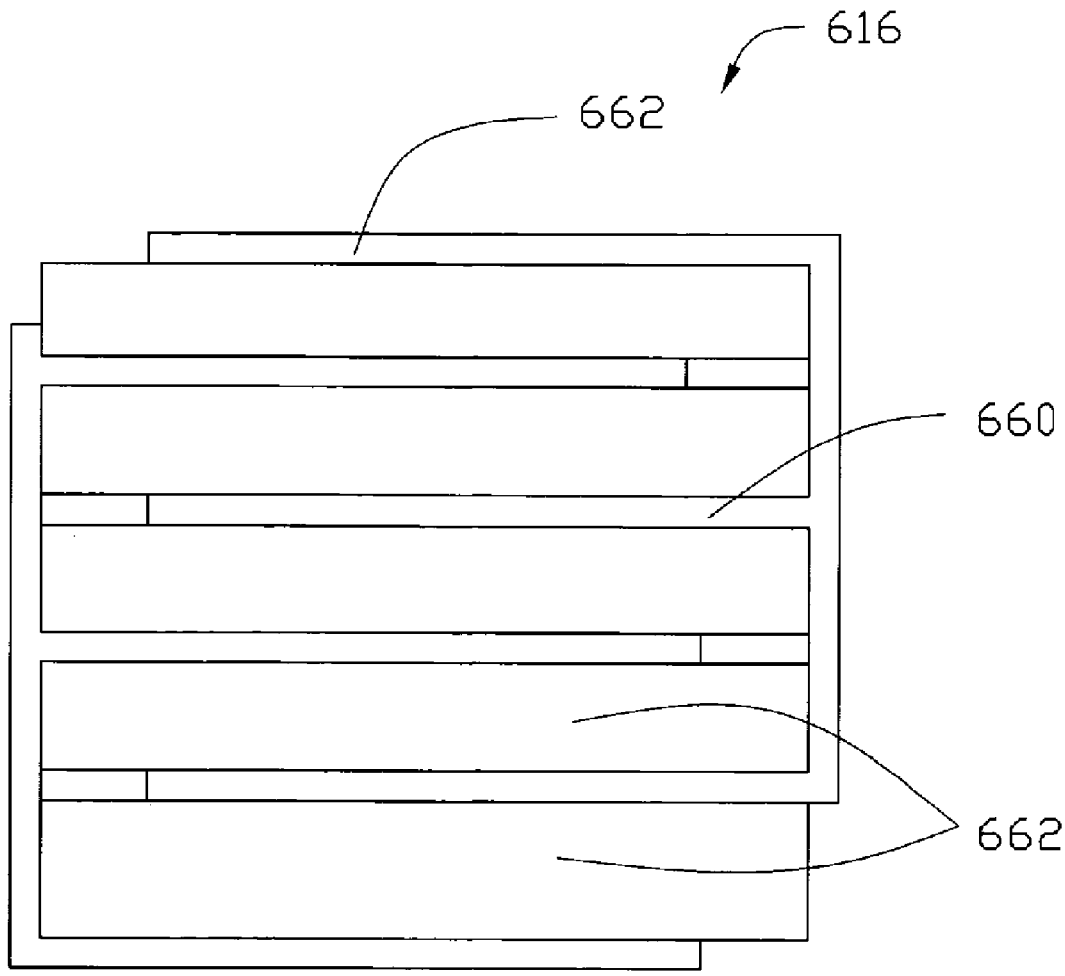
FIG. 6 shows another embodiment of a heating element of the electric heater.

FIG. 6 shows a second embodiment of a heating element 616 according to the present invention. In this embodiment, the heating element 616 includes a plurality of layer-structured PTC heating sheets 660. The heating sheets 660 are stacked together with each heating sheet 660 being sandwiched between two neighboring electric layers 662. The electric layers 662 connect to a positive electrode and a negative electrode of the power source in alternating fashion. The heating element 616 is received in the slot 142 of the lower electrode plate 14 with a bottom one of the electric layers 662 electrically connecting with the lower electrode plate 14; then, the upper electrode plate 12 is mounted on the lower electrode plate 14 and electrically connects with a top one of the electric layers 662. Therefore, each of the heating sheets 660 of the heating element 616 electrically connects with a positive electric layer 662 and a negative electrical layer 662 when the upper electrode plate 12 is connected to a positive terminal of the power source and the lower electrode plate 14 is connected to a negative terminal.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. An electric heating module comprising:

an electric heater comprising:

a pair of electrode plates parallel to each other;

a PTC (positive temperature coefficient) heating element sandwiched between and electrical connecting the electrode plates; and an electrically-insulating and thermally-conductive insulation frame enclosing the electrode plates therein;

a heat pipe having an evaporating section thermally attached to the electric heater and a condensing section; and at least one heat radiator thermally attached to the condensing section of the heat pipe.

2. The electric heating module as claimed in claim 1, wherein the heat pipe is a loop heat pipe.

3. The electric heating module as claimed in claim 2, wherein the heat pipe includes a planar shaped outer surface contacting the at least one heat radiator.

4. The electric heating module as claimed in claim 1, wherein the heating element comprises a plurality of heating sheets stacked together, two neighboring ones of the heating sheets are electrically connected the electrode plates, respectively.

5. The electric heating module as claimed in claim 1, wherein a slot is defined in at least one of the electrode plates receiving the heating element therein.

6. The electric heating module as claimed in claim 1, wherein the heat radiator comprises a base defining a notch receiving the electric heater therein and a plurality of fins extending therefrom.

7. The electric heating module as claimed in claim 6, wherein the base defines a groove receiving the heat pipe therein, the groove communicates the notch.

8. The electric heating module as claimed in claim 6, wherein the fins are arc shaped and parallel to each other, an arc shaped airflow channel is formed between each two neighboring fins.

9. The electric heating module as claimed in claim 8, further comprising a fan arranged at a side communicating with the airflow channels of the heat radiator for generating airflow.

10. The electric heating module as claimed in claim 1, wherein the at least one heat radiator comprises a first and second heat radiator thermally attaching to two opposite walls of the electric heater, a plurality of hooks extends from each heat radiator and engages with the corresponding hooks of the other heat radiator of the first and second heat radiators.

11. The electric heating module as claimed in claim 1, wherein the heating element comprises an electric layer formed on each of two opposite sides thereof for electrically connecting the electrode plates, the electric layers are made of one of the following materials: metal, metal oxide and superconducting materials.

12. The electric heating module as claimed in claim 11, wherein the metal oxide is selected from ITO-based materials or IZO-based materials.

13. The electric heating module as claimed in claim 12, wherein the superconducting material is selected from one of the following materials: $Yba_2Cu_3O_7$, $LaSr_2Cu_3O_7$ and their composites.

14. An electric heating module comprising:

a PTC (positive temperature coefficient) heating element;

electrode plates electrically connecting with the PTC heating element for supplying a current to the PTC heating element;

a heat pipe thermally connecting with the PTC heating element whereby heat generated by the PTC heating element is transmitted to the heat pipe and circulated in the heat pipe by phase change of working fluid in the heat pipe;

at least a heat radiator thermally connecting with the heat pipe whereby the heat transmitted to and circulated in the heat pipe is absorbed by the radiator and dissipated to surrounding air from the radiator.

15. The electric heating module as claimed in claim 14, wherein the at least a heat radiator has fins formed thereon, the fins being arc shaped and parallel to each other.

16. The electric heating module as claimed in the claim 14 further comprising a fan for generating an airflow through the at least a radiator.

17. The electric heating module as claimed in claim 16, wherein the at least a heat radiator has fins formed thereon, and the airflow generated by the fan flows through the fins.

18. The electric heating module as claimed in claim 17, wherein the fins are arc shaped and parallel to each other, an arc shaped airflow channel is formed between each two neighboring fins for the airflow flowing therethrough.

19. The electric heating module as claimed in claim 14, wherein the PTC heating element comprises an electric layer formed on each of two opposite sides thereof for electrically connecting the electrode plates, the electric layers are made of ITO-based materials or IZO-based materials.

20. The electric heating module as claimed in claim 14, wherein the PTC heating element comprises an electric layer formed on each of two opposite sides thereof for electrically connecting the electrode plates, the electric layers are made of one of the following materials: $Yba_2Cu_3O_7$, $LaSr_2Cu_3O_7$ and their composites.

* * * * *